US008278905B2

(12) United States Patent
Harvey et al.

(10) Patent No.: US 8,278,905 B2
(45) Date of Patent: Oct. 2, 2012

(54) ROTATING GAIN RESISTORS TO PRODUCE A BANDGAP VOLTAGE WITH LOW-DRIFT

(75) Inventors: Barry Harvey, Los Altos, CA (US); Steven Herbst, Cambridge, MA (US)

(73) Assignee: Intersil Americas Inc., Milpitas, CA (US)

( * ) Notice: Subject to any disclaimer, the term of this patent is extended or adjusted under 35 U.S.C. 154(b) by 383 days.

(21) Appl. No.: 12/718,840

(22) Filed: Mar. 5, 2010

(65) Prior Publication Data

US 2011/0127988 A1 Jun. 2, 2011

Related U.S. Application Data

(60) Provisional application No. 61/266,101, filed on Dec. 2, 2009.

(51) Int. Cl.
*G05F 3/16* (2006.01)

(52) U.S. Cl. ..... 323/313

(58) Field of Classification Search ..... 323/273, 323/274, 282–284, 312–317
See application file for complete search history.

(56) References Cited

U.S. PATENT DOCUMENTS 4,952,866 A 8/1990 Van Tuijl
5,440,254 A * 8/1995 Sundby ..... 327/79
5,519,354 A 5/1996 Audy
5,619,122 A 4/1997 Kearney et al.
5,796,280 A 8/1998 Tuozzolo
5,982,221 A 11/1999 Tuthill
6,008,685 A 12/1999 Kunst
6,019,508 A 2/2000 Lien
6,037,832 A 3/2000 Kaminishi
6,157,244 A 12/2000 Lee et al.
6,288,664 B1 9/2001 Swanson
6,407,622 B1 * 6/2002 Opris ..... 327/539
6,501,256 B1 * 12/2002 Jaussi et al. ..... 323/315
6,507,179 B1 * 1/2003 Jun et al. ..... 323/313
6,549,065 B2 * 4/2003 Opris ..... 327/539
6,554,469 B1 4/2003 Thomson et al.
6,642,778 B2 * 11/2003 Opris ..... 327/539
6,736,540 B1 5/2004 Sheehan et al.
6,890,097 B2 5/2005 Tanaka
6,914,475 B2 7/2005 Enriquez et al.
6,957,910 B1 10/2005 Wan et al.
7,083,328 B2 8/2006 Johnson
7,164,259 B1 * 1/2007 Megaw et al. ..... 323/313
7,170,334 B2 1/2007 Miranda et al.
7,193,543 B1 3/2007 McLeod et al.
7,236,048 B1 6/2007 Holloway et al.
(Continued)

OTHER PUBLICATIONS

Office Action for U.S. Appl. No. 12/111,796, issued Jul. 14, 2010.

(Continued)

*Primary Examiner* — Adolf Berhane
(74) *Attorney, Agent, or Firm* — Fliesler Meyer LLP

(57) ABSTRACT

In accordance with an embodiment of the present invention, a bandgap voltage reference circuit includes a plurality of circuit branches, a plurality of resistors and a plurality of switches. The plurality of switches are used to selectively change over time which of the resistors are connected to be within a first one of the circuit branches and which of the resistors are connected to be within a second one of the circuit branches, to thereby reduce the effects that long term drift of the resistors have on a bandgap voltage output (VGO) of the bandgap voltage reference circuit.

23 Claims, 7 Drawing Sheets

U.S. PATENT DOCUMENTS

| | | | | |
|---|---|---|---|---|
| 7,281,846 | B2 | 10/2007 | McLeod | |
| 7,309,157 | B1 | 12/2007 | Aslan et al. | |
| 7,312,648 | B2 | 12/2007 | Yang | |
| 7,321,225 | B2 | 1/2008 | Garlapati et al. | |
| 7,341,374 | B2 | 3/2008 | Chiu | |
| 7,368,973 | B2 | 5/2008 | Sato | |
| 7,420,359 | B1 * | 9/2008 | Anderson et al. | 323/316 |
| 7,579,860 | B2 | 8/2009 | Deken | |
| 7,724,075 | B2 * | 5/2010 | Yang et al. | 327/541 |
| 7,880,459 | B2 | 2/2011 | Harvey | |
| 2005/0001605 | A1 | 1/2005 | Marcina | |
| 2006/0255787 | A1 | 11/2006 | Schaffer et al. | |
| 2007/0152740 | A1 | 7/2007 | Georgescu et al. | |
| 2007/0252573 | A1 | 11/2007 | Tachibana et al. | |
| 2008/0095213 | A1 | 4/2008 | Lin et al. | |
| 2008/0278137 | A1 | 11/2008 | Harvey et al. | |
| 2010/0002748 | A1 | 1/2010 | Lin et al. | |

OTHER PUBLICATIONS

K. Kujik, "A Precision Reference Voltage Source," IEEE J. Solid State Circuits, vol. SC-8, Jun. 1973, pp. 222-226.

B. Song, et al., "A Precision Curvature-compensated CMOS Bandgap Reference," IEEE J. Solid State Circuits, vol. SC-18, Dec. 1983, pp. 634-643.

M. Tuthill, "A Switched-current, Switched-capacitor Temperature Sensor in 0.6 um CMOS," IEEE J. Solid State Circuits, vol. SC-33, Jul. 1998, pp. 1117-1122.

M. Pertijs, et al., "A cmos Smart Temperature Sensor with a 3 Sigma Inaccuracy of +/-0.5 deg C from —50 to 120 deg C," IEEE J. Solid State Circuits, vol. SC-40, Feb. 2005, pp. 454-461.

M. Pertijs, et al., "A CMOS Smart Temperature Sensor with a 3 sigma Inaccuracy of +/-0.1 deg C from -55 to 125 deg C," IEEE J. Solid State Circuits, vol. SC-40, Dec. 2005, pp. 2805-2815.

J. Huijsing, et al., "Analog Circuit Design", Boston/Dordrecht/London: Kluwer Academic, 1996,pp. 263, 350-351.

M. Pertijs, et al. "A High-Accuracy Temperature Sensor with Second-order Curvature Correction and Digital Bus Interface", in Proc. ISCAS, May 2001, pp. 368-371.

Office Action for U.S. Appl. No. 12/717,052, issued Feb. 21, 2012.

R. Pease, "The Design of Band-Gap reference Circuits: Trials and Tribulations," IEEE Proceedings of the 1990 Bipolar Circuits and Technology Meeting, Sep. 17-18, 1990.

P. Malcovati,et al., "Curvature-Compensated BiCMOS Bandgap with 1-V Supply Voltage," IEEE J. Solid state Circuits, vol. 36, No. 7 Jul. 2001, pp. 1076-1081.

* cited by examiner

ROTATING GAIN RESISTORS TO PRODUCE A BANDGAP VOLTAGE WITH LOW-DRIFT

PRIORITY CLAIM

This application claims priority under 35 U.S.C. 119(e) to U.S. Provisional Application No. 61/266,101, filed Dec. 2, 2009, entitled ROTATING GAIN RESISTORS TO PRODUCE A BANDGAP VOLTAGE WITH LOW-DRIFT, which is incorporated herein by reference.

BACKGROUND

A bandgap voltage reference circuit can be used, e.g., to provide a substantially constant reference voltage for a circuit that operates in an environment where the temperature fluctuates. A bandgap voltage reference circuit typically adds a voltage complimentary to absolute temperature (VCTAT) to a voltage proportional to absolute temperature (VPTAT) to produce a bandgap reference output voltage (VGO). The VCTAT is typically a simple diode voltage, also referred to as a base-to-emitter voltage drop, forward voltage drop, base-emitter voltage, or simply VBE. Such a diode voltage is typically provided by a diode connected transistor (i.e., a BJT transistor having its base and collector connected together). The VPTAT can be derived from one or more VBE, where ΔVBE (delta VBE) is the difference between the VBEs of BJT transistors having different emitter areas and/or currents, and thus, operating at different current densities.

FIG. 1A illustrates an exemplary conventional bandgap voltage reference circuit 100, including transistors Q1 through QN connected in parallel (in the "N" branch), a transistor QN+1 (in the "1" branch), and a further transistor QN+2 (in the "CTAT" branch).

The bandgap voltage reference circuit 100 also includes an amplifier 120 and three PMOS transistors M1, M2 and M3 that are configured to function as current sources that supply currents to the "N", "1", and "CTAT" branches. Since the gates of the PMOS transistors are tied together, and their source terminals are all connected to the positive voltage rail (VDD), the source-to-gate voltages of these transistors are equal. As a result, the "N", "1", and "CTAT" branches receive and operate at approximately the same current, Iptat.

In FIG. 1A the transistor QN+2 is used to generate the VCTAT, and the transistors Q1 through QN in conjunction with transistor QN+1 are used to generate the VPTAT. More specifically, the VCTAT is a function of the base emitter voltage (VBE) of diode connected transistor QN+2, and the VPTAT is a function of ΔVBE, which is a function of the difference between the base-emitter voltage of transistor QN+1 and the base-emitter voltage of diode connected transistors Q1 through QN connected in parallel.

Due to negative feedback, the amplifier 120 adjusts the common PMOS gate voltage of current source transistors M1, M2 and M3 until the non-inverting (+) and inverting (−) inputs of the amplifier 120 are at equal voltage potentials. This occurs when Iptat*R1+$VBE_{1,2,\ldots,n}$=$VBE_{n+1}$, where $VBE_{1,2,\ldots,n}$=$VBE_{n+1}$−ΔVBE. Thus, Iptat=ΔVBE/R1.

Here, the bandgap voltage output (VGO) is as follows:

$$VGO = VCTAT + VPTAT,$$

$$= VBE + R2/R1 * V_T * \ln(N).$$

where Vt is the thermal voltage, which is about 26 mV at room temperature.

If VBE~0.7V, and R2/R1*$V_T$*ln(N)~0.5V, then VGO~1.2V.

The current sources can be implemented using alternative configurations than shown in FIG. 1A. Accordingly, FIG. 1B is provided to show the more general circuit. As was the case in FIG. 1A, in FIG. 1B the amplifier 120 controls the current sources $I_1$, $I_2$ and $I_3$.

The voltage across R2 is proportioned to temperature and when it is scaled to about 0.5V at room temperature it makes VGO relatively constant with temperature by compensating the negative temperature coefficient of $VBE_3$ (i.e., the base emitter voltage of transistor Q3).

For N=8, which is a common value for N, $$\frac{R2}{R1} \sim 9$$

for a good temperature coefficient (tempco) of VGO. R2 can be provided by connecting three unit resistors in series, and R1 can be provided by connecting another three unit resistors in parallel. This is a common practice and makes the ratio of 9 very accurate in manufactured circuits.

In practice, long term drift in unit resistor values can cause long term drift in VGO, which is undesirable.

SUMMARY

Certain embodiments of the present invention are directed to bandgap voltage reference circuits that reduce the affects that long term drift of resistors have on the bandgap voltage output (VGO) produced by the bandgap voltage reference circuits. In accordance with an embodiment of the present invention, a bandgap voltage reference circuit includes a plurality of resistors, a plurality of circuit branches, and a plurality of switches. The plurality of circuit branches of the bandgap voltage reference circuit (e.g., an "N", a "1" and a "CTAT" branch) are collectively used to produce the bandgap voltage output (VGO). The plurality of switches (e.g., controlled by a controller) are used to selectively change over time which of the resistors are connected to be within a first one of the circuit branches (e.g., the "N" branch) and which of the resistors are connected to be within a second one of the circuit branches (e.g., the "CTAT" branch).

In some embodiments, the plurality of resistors include a first group of resistors and a second group of resistors, and the plurality of switches include a first group of switches and a second group of switches. In such embodiments, the first group of switches can be used to selectively connect the first group of resistors in parallel with one another within the first one of the circuit branches at some times, and to selectively connect the first group of resistors in series with one another within the second one of the circuit branches at other times. Similarly, the second group of switches can be used to selectively connect the second group of resistors in series with one another within the second one of the circuit branches at some times, and to selectively connect the second group of resistors in parallel with one another within the first one of the circuit branches at other times.

In specific embodiments, each of the resistors within the first and second groups of resistors is a unit resistor that is substantially the same size as the other ones of the unit resistors within the first and second groups of resistors.

In certain embodiments, each of the resistors within the first and second groups of resistors spends about a same amount of time connected in parallel within the first one of the circuit branches as connected in series within the second one of the circuit branches.

In accordance with specific embodiments, at least some of the resistors spend at least some time not connected within any of the plurality of circuit branches which are collectively used to produce the bandgap voltage output (VGO), even though at other times the same resistors spend time connected within one or more of the plurality of circuit branches which are collectively used to produce the bandgap voltage output (VGO).

Embodiments of the present invention are also directed to methods for use with bandgap reference circuits that produce a bandgap voltage output (VGO), where the bandgap voltage reference circuits include a plurality of circuit branches that are collectively used to produce the bandgap voltage output (VGO). Such methods can include selectively changing over time which of a plurality of resistors are connected to be within a first one of the circuit branches, and selectively changing over time which of the resistors are connected to be within a second one of the circuit branches.

Embodiments of the present invention are also directed to voltage regulators that include a bandgap voltage reference circuit, such as the one described above, but not limited thereto. The voltage regulators can be, e.g., fixed output or adjustable output linear voltage regulators, but are not limited thereto.

This summary is not intended to summarize all of the embodiments of the present invention. Further and alternative embodiments, and the features, aspects, and advantages of the various embodiments will become more apparent from the detailed description set forth below, the drawings and the claims.

DETAILED DESCRIPTION

Figure 1A:
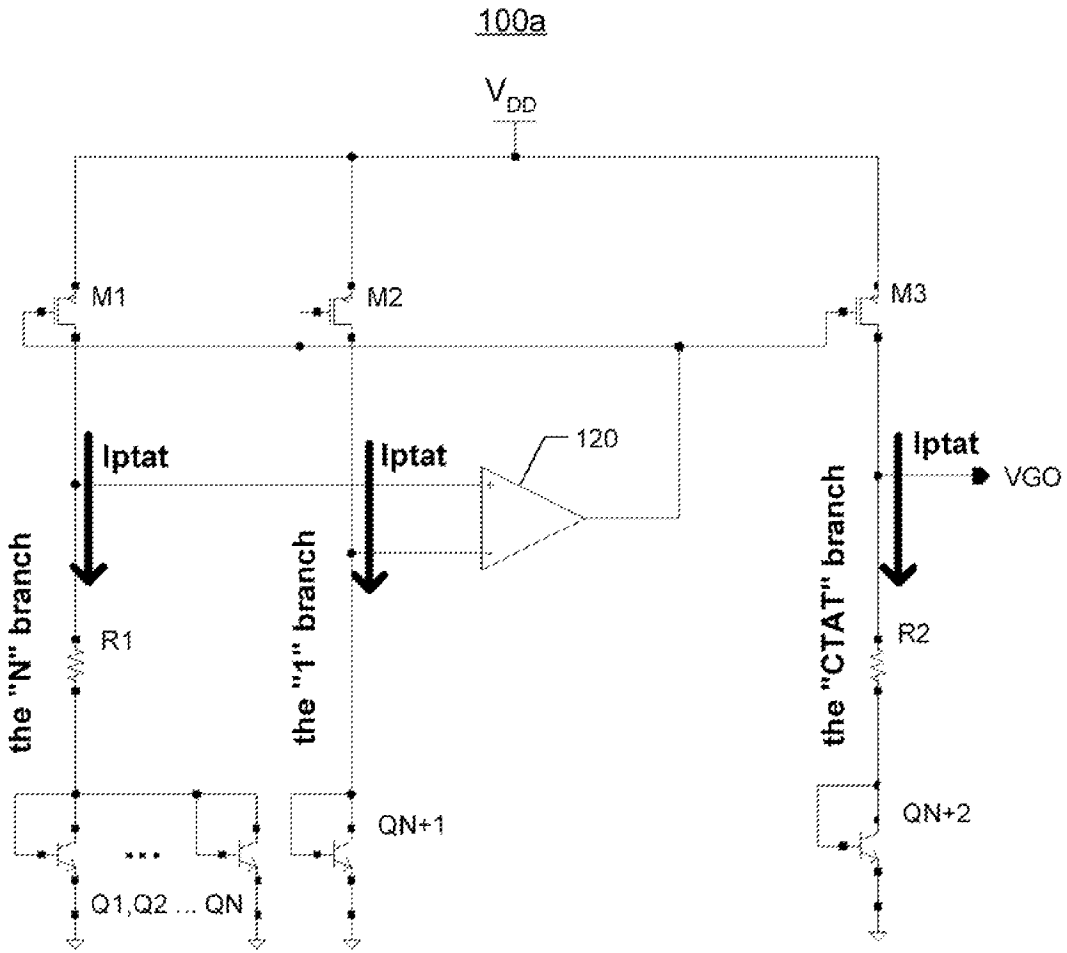
FIG. 1A (prior art)
FIGS. 1A and 1B illustrate exemplary conventional bandgap voltage reference circuits.

Embodiments of the present invention can be used to reduce long term drift in VGO that is due to drift long term drift in resistor values. Certain embodiments of the present invention, as can be appreciated from the discussion below, can also be used to compensate for imperfect resistor values.

In accordance with an embodiment of the present invention, a bandgap voltage reference circuit includes two groups of unit resistors all of substantially identical size. Referring, for example, to resistor values R1 and R2 in FIGS. 1A and 1B, in accordance with an embodiment, one of the groups of unit resistors is alternately connected in parallel to provide R1, then reconfigured (e.g., switched) to be connected in series to provide R2. The other group of unit resistors is similarly alternatively connected in series to provide R2, then reconfigured (e.g., switched) to be connected in parallel to provide R1. When a unit resistor is being used to provide R1, that unit resistor can be said to be in the R1 position. Similarly, when a unit resistor is being used to provide R2, that unit resistor can be said to be in the R2 position.

If a first group of unit resistors is used to provide R1 and R2 for equal amounts of time, and a second group of unit resistors is used to provide R2 and R1 for equal amounts of time, then excellent rejection of individual resistor error and drift over time occurs, as will be appreciated from the discussion below.

Assume that six unit resistors (i.e., two groups of unit resistors, with three unit resistors in each group) are used to provide R1 and R2, and that all except one of the six unit resistors are perfect and provide a resistance exactly equal to a value R. Also assume that the resistance value for the imperfect unit resistor is R+ΔR. Under these assumptions, when the imperfect unit resistor is connected in parallel with two of the perfect unit resistors, then the resistance value for R1 is as follows:

$$R1 = \frac{1}{\frac{1}{R} + \frac{1}{R} + \frac{1}{R + \Delta R}}.$$

For ΔR<<R, then $$R1 = R\left(\frac{1 + \frac{\Delta R}{R}}{3}\right).$$

When the three unit resistors (of the group that includes the imperfect unit resistor) are switched to be in series with one another in the R2 position, their value is R2=3R+ΔR.

If the two group of unit resistors are each used half the time to provide R1, and are used the other half of the time to provide R2, then the time average of the imperfect group and the perfect group is as follows:

$$\begin{aligned}\overline{R_1} &= \frac{1}{2}\left(\frac{R}{3}\right) + \frac{1}{2}(R\left(\frac{1 + \frac{\Delta R}{R}}{3}\right) \\ &= \frac{R}{6}\left(1 + \left(1 + \frac{\Delta R}{R}\right)\right) \\ &= \frac{R}{3}\left(1 + \frac{1}{2} * \frac{\Delta R}{R}\right).\end{aligned}$$

Similarly, the average value of R2 is as follows:

$$\overline{R_2} = \frac{1}{2}(3R) + \frac{1}{2}(3R + \Delta R)$$

-continued $$= 3R + \frac{\Delta R}{2}$$

$$= 3R\left(1 + \frac{1}{2} * \frac{\Delta R}{R}\right)$$

The average value of $$\frac{\overline{R_2}}{\overline{R_1}} = \frac{3R\left(1 + \frac{1}{2} * \frac{\Delta R}{R}\right)}{\frac{R}{3}\left(1 + \frac{1}{2} * \frac{\Delta R}{R}\right)} = 9$$

exactly.

As can be appreciated from the above, so as long as ΔR<<R, any one unit resistor variation from the group cancels out, as long as the amount of time the first group is used to provide R1 equals the amount of time the first group is used to provide R2, and the amount of time the second group is used to provide R1 equals the amount of time the second group is used to provide R2. Further, it is noted that more than two groups may be employed to provide R1 and R2 over time. Specific embodiments that benefit from the use of more than two groups of unit resistors are discussed below.

Figure 2A:
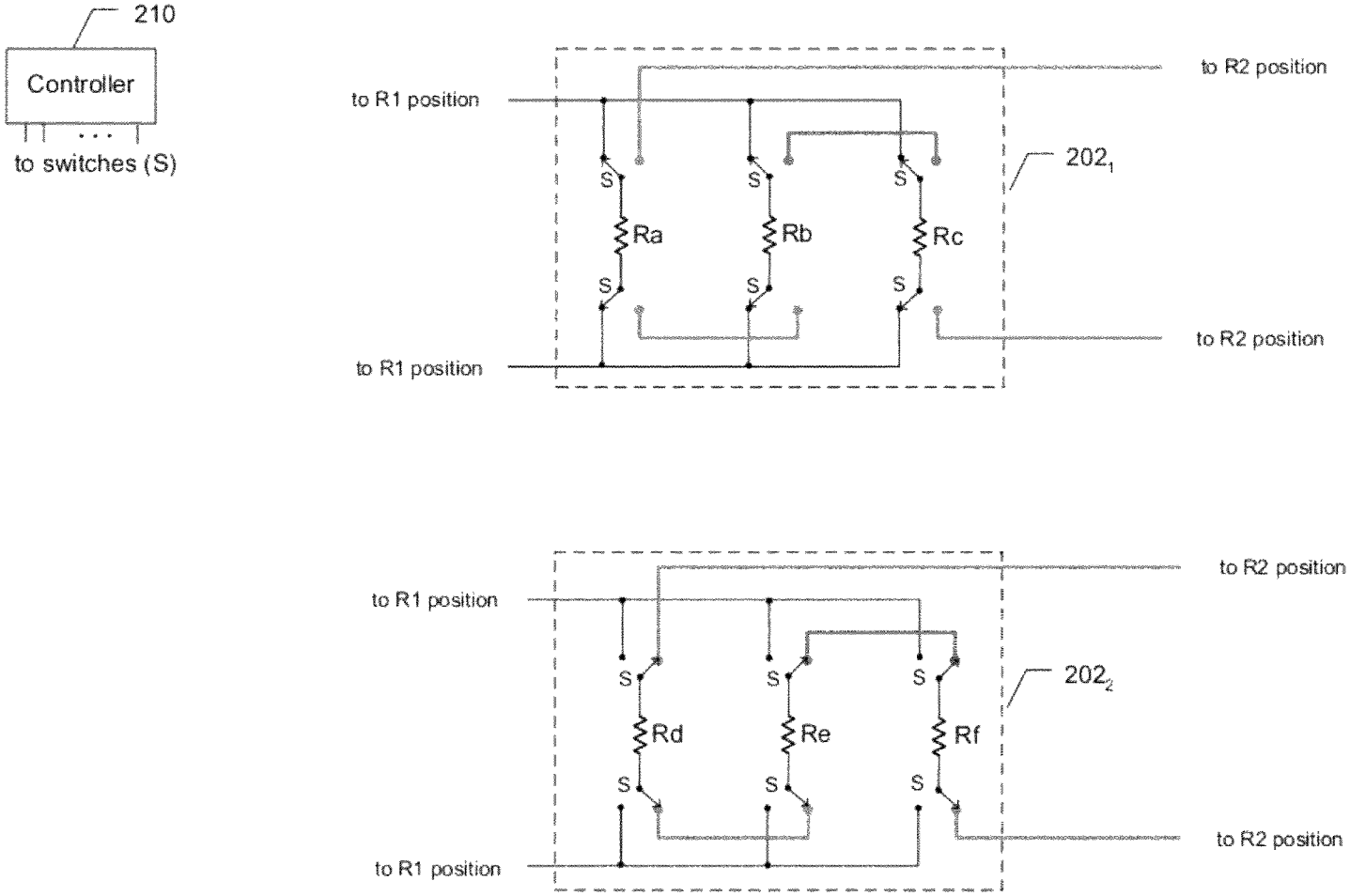
FIG. 2A illustrate groups of unit resistors that can be used within a bandgap voltage reference circuit to provide a low-drift bandgap voltage reference circuit, in according with an embodiment of the present invention.

There are numerous ways in which a group of resistor units can be configured to be selectively changed from being connected in parallel to provide R1 to being connected in series to provide R2. FIG. 2A illustrates one such way. Referring to FIG. 2A, when the switches S are in their left positions, a first group of unit resistors Ra, Rb and Rc (labeled $\mathbf{202}_1$) are connected in parallel and are used to provide R1; and when the switches S are in their right positions the group of unit resistors Ra, Rb and Rc are connected in series and are used to provide R2. In FIG. 2A, the second group of unit resistors Rd, Re and Rf (labeled $\mathbf{202}_2$) can similarly be switched from being connected in series in the R2 position to being connected in parallel in the R1 position.

Figure 1B:
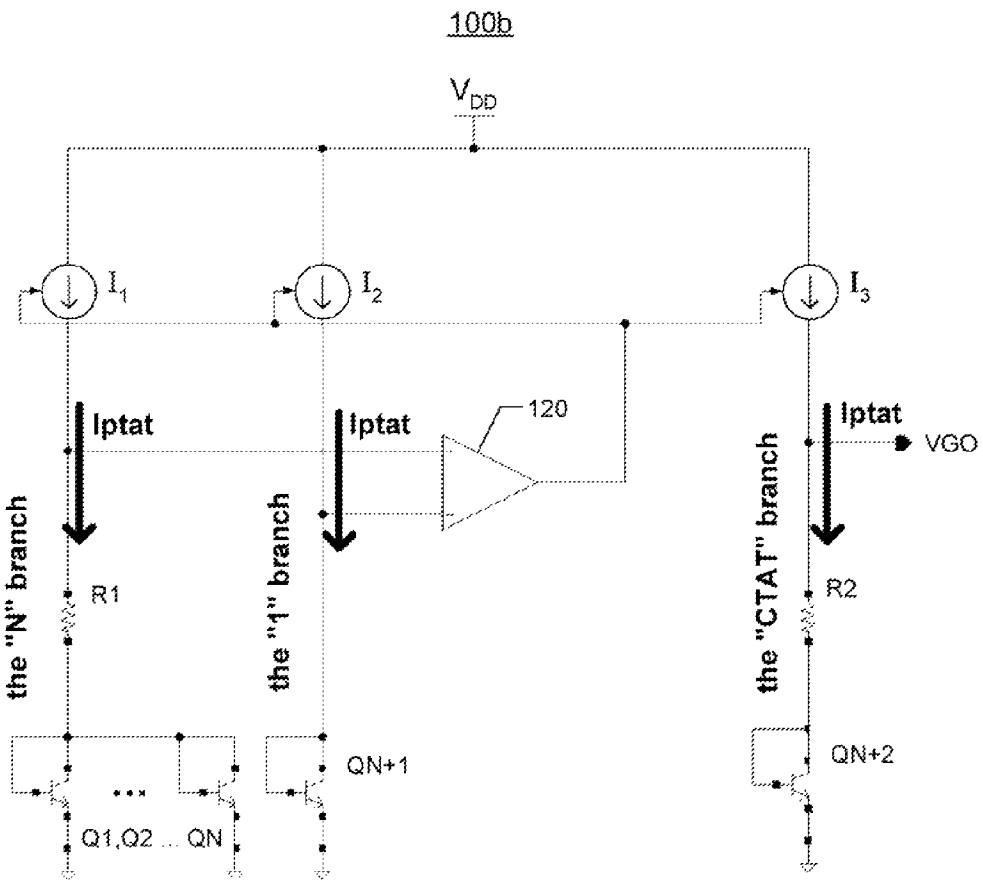
FIG. 1B (prior art)
Figure 2B:
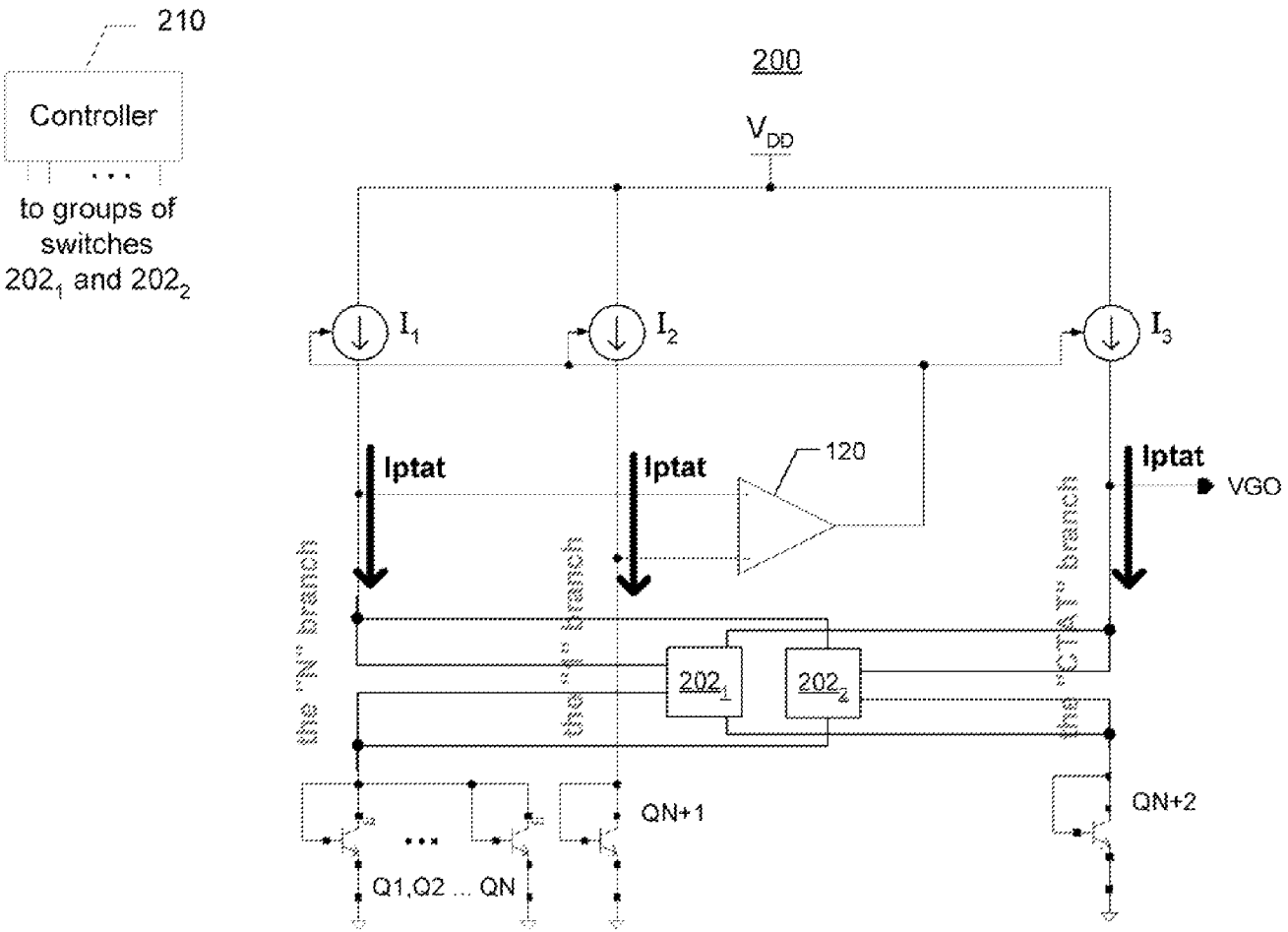
FIG. 2B illustrates how the groups of unit resistors of FIG. 2A can be used in place of the resistors R1 and R2 in FIGS. 1A and 1B to provide a low-drift bandgap voltage reference circuit, in according with an embodiment of the present invention.

FIG. 2B illustrates how the groups of unit resistors $\mathbf{202}_1$ and $\mathbf{202}_2$ of FIG. 2A can be used in place of the resistors R1 and R2 in FIGS. 1A and 1B to provide a low-drift bandgap voltage reference circuit 200, in according with an embodiment of the present invention.

In FIGS. 2A and 2B, a controller 210 controls with switches S to change how each group of resistors is configured and connected. For example, referring to FIGS. 2A and 2B, the controller 210 can control the switches such that the three unit resistors (Ra, Rb and Rc) within the group of resistors $\mathbf{202}_1$ are connected in parallel and within the "N" branch one-half of the time, and such that the three unit resistors (Ra, Rb and Rc) within the group of resistors $\mathbf{202}_1$ are connected in series and within the "CTAT" branch the other half of the time. Similarly, the controller 210 can control the switches such that the three unit resistors (Rd, Re and Rf) within the group of resistors $\mathbf{202}_2$ are connected in series and within the "CTAT" branch one-half of the time, and such that the three unit resistors (Rd, Re and Rf) within the group of resistors $\mathbf{202}_2$ are connected in parallel and within the "N" branch the other half of the time.

In FIG. 2A each switch is shown as a single-pole-double-throw switch, but embodiments of the present invention are not limited thereto. For example, in place of each single-pole-double-throw switch, two single-pole-single-throw switches can be used, but two such switches will still be referred to collectively as a switch. The switches can be implemented, e.g., using CMOS transistors, but are not limited thereto. The controller 210 can be implemented by a simple counter, a state machine, a micro-controller, or a processor, but is not limited thereto.

In accordance with certain embodiments, there can be more groups of resistors than branches in the bandgap reference voltage circuit. For a specific example, there can be X groups of resistors (e.g., similar to groups $\mathbf{202}_1$ and $\mathbf{202}_2$), where X≧2, and each of the X groups of unit resistors spends $1/X^{th}$ of their time connected in parallel within the "N" branch, and 1/Xth of the time connected in series in the "CTAT" branch. Where X>2, at any give time at least one of the X groups of resistors may not be connected within the bandgap voltage reference circuit and not used to produce the bandgap voltage output (VGO), even though at other times the resistors in that group are connected within the bandgap voltage reference circuit and used to produce the bandgap voltage output (VGO). The resistors not used to produce VGO (i.e., the resistors temporarily switched out of the bandgap voltage reference circuit) may not be used, may be used in one or more other circuit, or may be used in some other manner.

In some embodiments, at any given time X unit resistors (which change over time) are connected in parallel within the "N" branch to provide the resistance R1, and Y unit resistors (which also change over time) are connected in series within the "CTAT" branch to provide the resistance R2, where X≠Y. In such embodiments, each unit resistor may spend more time in one of the branches than in the other branch, yet still provide for low drift.

In certain embodiments, the collection of resistors that are connected in the R1 position (to provide the resistance value R1) at any given time can include some resistors connected in parallel, and other resistors connected in series. Similarly, the collection of resistors that are connected in the R2 position (to provide the resistance value R2) at any given time can include some resistors connected in parallel, and other resistors connected in series. As was the case in the embodiments described above, switches that are controlled by a controller can be used to selectively change over time which of the resistors are connected to be in the R1 position, and which of the resistors are connected to be within the R2 position. In these embodiments, the controller can also change over time which resistors in the R1 position are in parallel and which are in series, and change over time which resistors in the R2 position are in parallel and which are in series. In accordance with an embodiment, a ratio of the resistance provided by the resistors in the R2 position (which can be referred to as resistance R2) over the resistance provided by the resistors in the R1 position (which can be referred to as resistance R1) should always be substantially constant (e.g., R2/R1=9).

Where multiple groups of resistors are used to provide the resistances R1 and R2, one group of resistors may be used to provide R1 at some times and R2 at other times, while another group of resistors may be used to provide R2 at some times and R1 at other times, e.g., by changing whether resistors within the groups are connected in series or parallel, and changing which branch the group of resistors is connected into. In some such embodiments, each resistor (e.g., resistor unit) may always stay within a same group, even though how and where the resistor is connected can change. In other embodiments, a resistor can be moved (e.g., switched) into and out of different groups.

Figure 3:
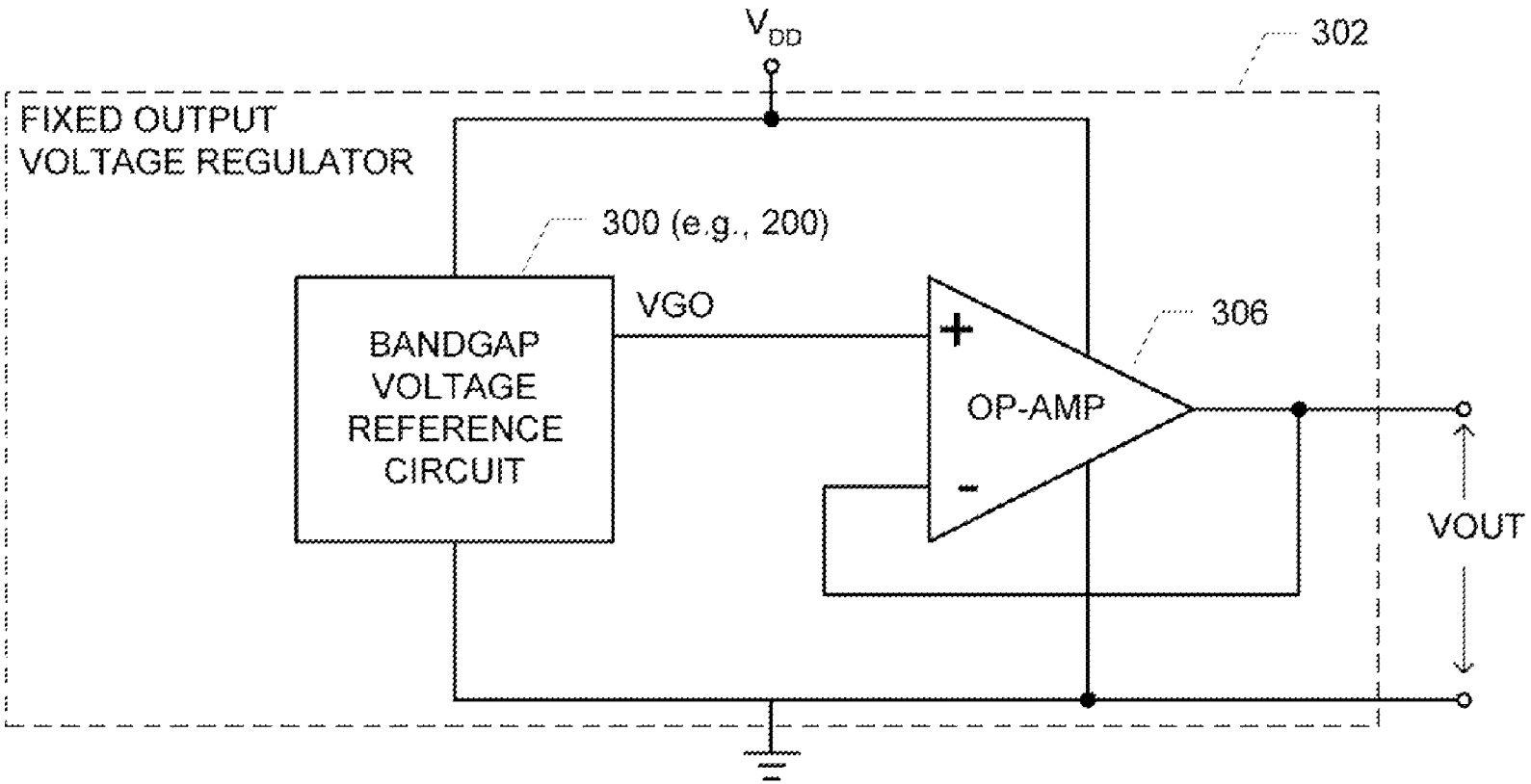
FIG. 3 is a block diagram of an exemplary fixed output linear voltage regulator that includes a low-drift bandgap voltage reference circuit according to an embodiment of the present invention.

FIG. 3 is a block diagram of an exemplary fixed output linear voltage regulator 302 that includes a bandgap voltage reference circuit 300 (e.g., 200 in FIG. 2B, but not limited thereto) according to an embodiment of the present invention described above. The bandgap voltage reference circuit 300 produces a bandgap voltage output (VGO), which is provided to an input (e.g., a non-inverting input) of an operational-amplifier 306, which is connected as a buffer. The other input (e.g., the inverting input) of the operation-amplifier 306 receives an amplifier output voltage (VOUT) as a feedback signal. The output voltage (VOUT), through use of the feedback, remains substantially fixed, +/−a tolerance (e.g., +/−1%).

Figure 4:
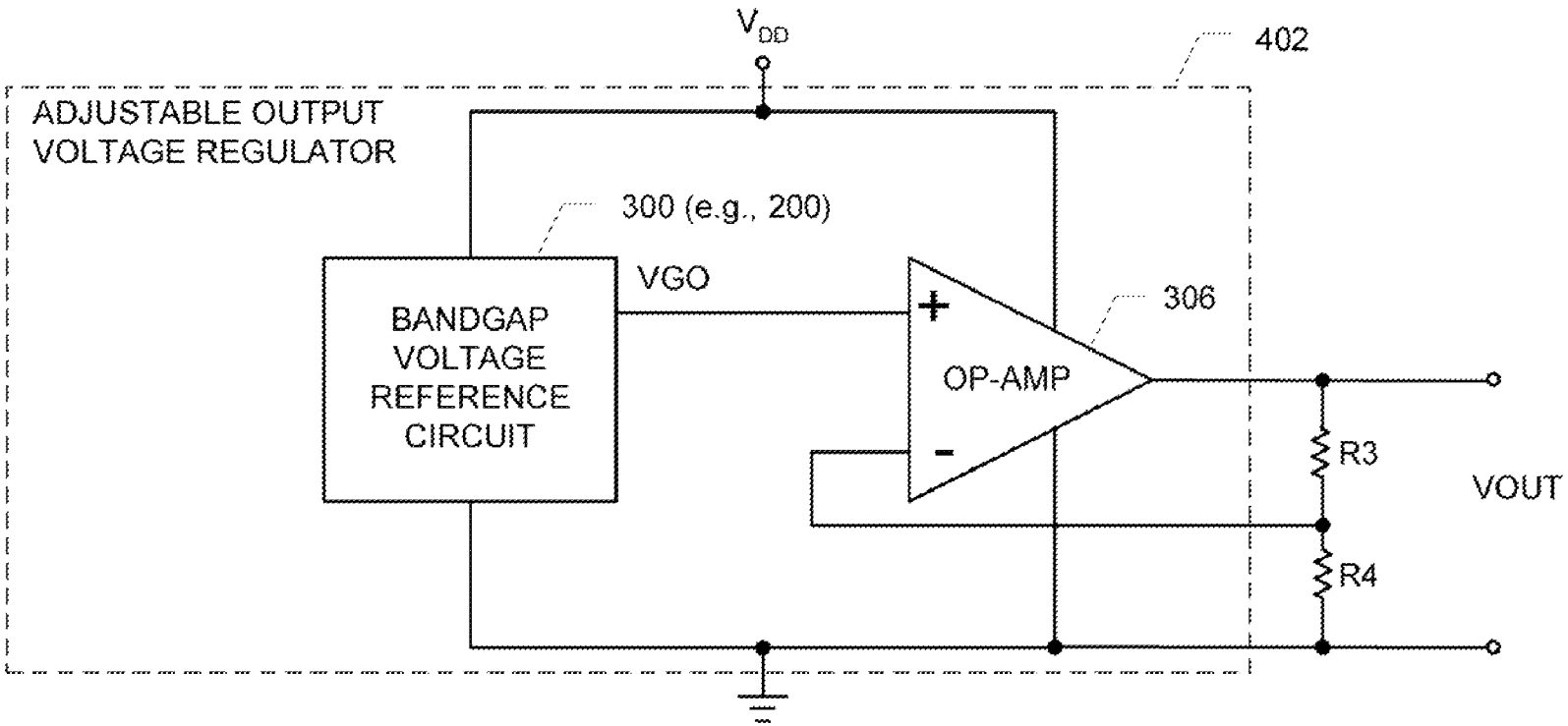
FIG. 4 is a block diagram of an exemplary adjustable output linear voltage regulator that includes a low-drift bandgap voltage reference circuit according to an embodiment of the present invention.

FIG. 4 is a block diagram of an exemplary adjustable output linear voltage regulator 402 that includes a bandgap voltage reference circuit 300 (e.g., 200 in FIG. 2B, but not limited thereto) according to an embodiment of the present invention described above. As can be appreciated from FIG. 4, VOUT≈VGO*(1+R3/R4). Thus, by selecting the appropriate values for resistors R3 and R4, the desired VOUT can be selected. The resistors R3 and R4 can be within the regulator, or external to the regulator. One or both resistors can be programmable or otherwise adjustable.

Figure 5:
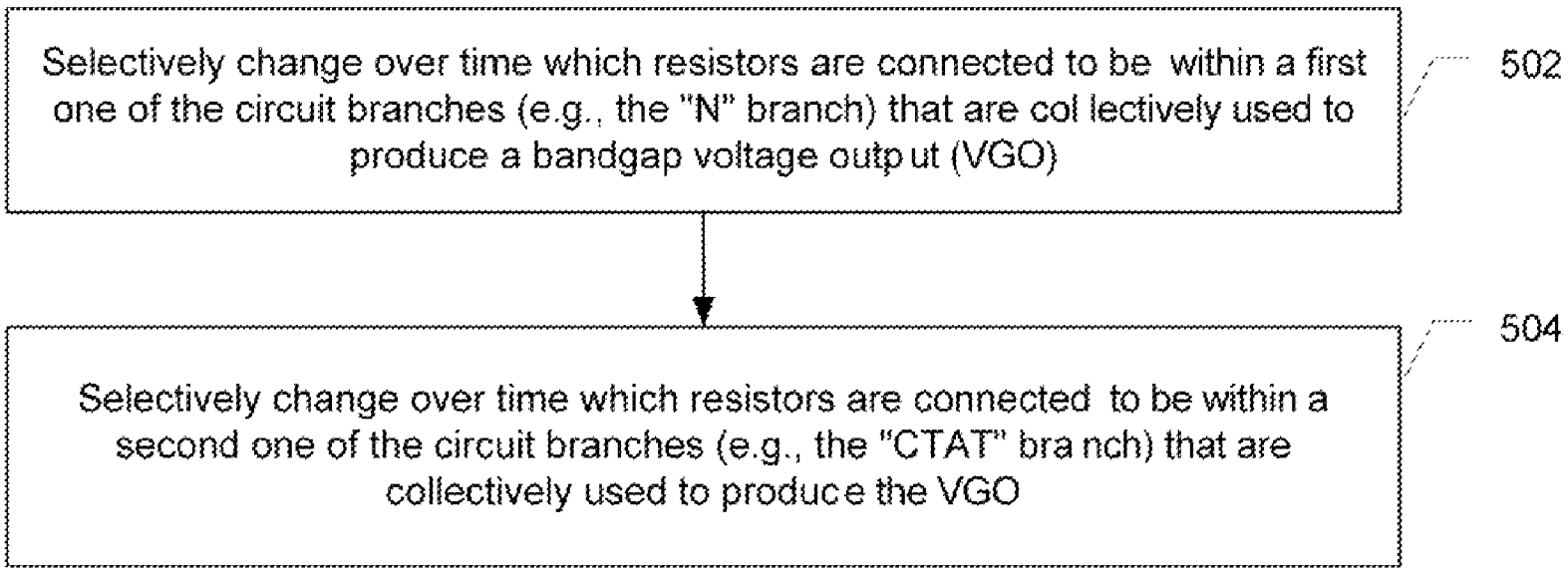
FIG. 5 is a high level flow diagram that is used to summarize a method for providing a low-drift bandgap voltage reference circuit according to an embodiment of the present invention.

FIG. 5 is a high level flow diagram that is used to summarize a method for providing a low-drift bandgap voltage reference circuit according to an embodiment of the present invention. Such a method is for use with a bandgap voltage reference circuit that produces a bandgap voltage output (VGO), wherein the bandgap voltage reference circuit includes a plurality of circuit branches (e.g., an "N" branch, a "1" branch and a "CTAT" branch) that are collectively used to produce the bandgap voltage output (VGO). Referring to FIG. 5, as indicated at step 502, there is a selective changing over time of which of the resistors are connected to be within a first one of the circuit branches (e.g., the "N" branch). Also, as indicated at step 504, there is a selectively changing over time of which of the resistors are connected to be within a second one of the circuit branches (e.g., the "CTAT" branch).

In accordance with specific embodiments, steps 502 and 504 can be performed such that the resistors that are connected within the first one of the circuit branches (e.g., the "N" branch) should always collectively provide a substantially constant first resistance (R1), and the resistors that are connected within the second one of the circuit branches should always collectively provide a substantially constant second resistance (R2). This will ensure that the ratio of the second resistance over the first resistance should always be substantially constant. However, there are other ways to ensure that this ratio remains constant that are also within the scope of the present invention.

As was described above with reference to FIGS. 2A and 2B, step 502 can be accomplished by connecting a first group of resistors in parallel with one another within the first one of the circuit branches at some times, and connecting a second group of resistors in parallel with one another within the first one of the circuit branches at other times. Similarly, step 504 can be accomplished by connecting the second group of resistors in series with one another within the second one of the circuit branches at some times, and connecting the first group of resistors in series with one another within the second one of the circuit branches at other times. Additional and alternative details of methods of the present invention can be appreciated from the description set forth above.

The foregoing description is of the preferred embodiments of the present invention. These embodiments have been provided for the purposes of illustration and description, but are not intended to be exhaustive or to limit the invention to the precise forms disclosed. Many modifications and variations will be apparent to a practitioner skilled in the art. For example, embodiments of the present invention can be used with various other bandgap voltage reference circuits that include gain resistors R1 and R2. Thus, embodiments of the present invention are not intended to be limited to use with only the bandgap reference circuits shown in FIGS. 1A and 1B.

While in the FIGS. the diode connected transistors are shown as being NPN transistors, they can alternatively be diode connected PNP transistors.

Further, while in FIG. 1A each current source is shown as being implemented using a single PMOS transistor, the current sources can alternatively be implemented using PNP transistors, or cascoded current sources including multiple PMOS or PNP transistors, as can be appreciated from the more general FIGS. 1B and 2B. These are just a few examples, which are not meant to be limiting.

While in the FIGS. the current sources are shown as being connected to the high voltage rail, that is not necessary. For example, in alternative embodiments, the current sources can be connected between the diode connected transistors and the low voltage rail, e.g., ground, to thereby cause Iptat to equivalently flow through each branch. Such embodiments are also within the scope of the present invention. Further, even though in these alternative embodiments the current Iptat may be considered to be "sunk" instead of "sourced", the devices used to cause the flow of Iptat will still be referred to as current sources.

Embodiments were chosen and described in order to best describe the principles of the invention and its practical application, thereby enabling others skilled in the art to understand the invention. Slight modifications and variations are believed to be within the spirit and scope of the present invention. It is intended that the scope of the invention be defined by the following claims and their equivalents.

What is claimed is:

1. A bandgap voltage reference circuit to produce a bandgap voltage output (VGO), comprising:

a plurality of resistors;

a plurality of circuit branches of the bandgap voltage reference circuit including a first one of the circuit branches used to produce a voltage proportional to absolute temperature (VPTAT), and a second one of the circuit branches used to produce a voltage complementary to absolute temperature (VCTAT), wherein with the VPTAT and the VCTAT are collectively used to produce the bandgap voltage output (VGO); and a plurality of switches to selectively change over time which of the resistors are connected to be within the first one of the circuit branches used to produce the VPTAT and which of the resistors are connected to be within the second one of the circuit branches used to produce the VCTAT.

2. The bandgap voltage reference circuit of claim 1, wherein:

at any given time the resistors that are connected within the first one of the circuit branches provide a first resistance, and the resistors that are connected within the second one of the circuit branches provide a second resistance; and the values of the first and second resistances can change over time so long as a ratio of the second resistance over the first resistance remains substantially constant.

3. A bandgap voltage reference circuit to produce a bandgap voltage output (VGO), comprising:

a plurality of resistors;

a plurality of circuit branches of the bandgap voltage reference circuit which are collectively used to produce the bandgap voltage output (VGO); and a plurality of switches to selectively change over time which of the resistors are connected to be within a first one of the circuit branches and which of the resistors are connected to be within a second one of the circuit branches;

wherein the plurality of resistors include a first group of resistors, and a second group of resistors; and wherein the plurality of switches include a first group of switches to selectively connect the first group of resistors in parallel with one another within the first one of the circuit branches at some times, and selectively connect the first group of resistors in series with one another within the second one of the circuit branches at other times; and a second group of switches to selectively connect the second group of resistors in series with one another within the second one of the circuit branches at some times, and selectively connect the second group of resistors in parallel with one another within the first one of the circuit branches at other times.

4. The bandgap voltage reference circuit of claim 3, wherein each of the resistors within the first and second groups of resistors comprises a unit resistor that is substantially the same size as the other ones of the unit resistors within the first and second groups of resistors.

5. The bandgap voltage reference circuit of claim 4, wherein each of the resistors within the first and second groups of resistors spends about a same amount of time connected in parallel within the first one of the circuit branches as connected in series within the second one of the circuit branches.

6. The bandgap voltage reference circuit of claim 4, wherein:

the first group of resistors comprises three said unit resistors; and the second group of resistors comprises three further said unit resistors.

7. The bandgap voltage reference circuit of claim 1, wherein each of the plurality of resistors comprises a unit resistor that is substantially the same size as the other ones of the resistors within the plurality of resistors.

8. The bandgap voltage reference circuit of claim 1, wherein each of the resistors spends about a same amount of connected within the first one of the circuit branches as connected within the second one of the circuit branches.

9. The bandgap voltage reference circuit of claim 1, wherein:

at least some of the resistors spend at least some time not connected within any of the plurality of circuit branches which are collectively used to produce the bandgap voltage output (VGO), even though at other times said at least some of the resistors spend time connected within one or more of the plurality of circuit branches which are collectively used to produce the bandgap voltage output (VGO).

10. The bandgap reference circuit of claim 1, further comprising:

a controller to control the switches.

11. A method for use with a bandgap voltage reference circuit that produces a bandgap voltage output (VGO), wherein the bandgap voltage reference circuit comprises a plurality of circuit branches including a first one of the circuit branches used to produce a voltage proportional to absolute temperature (VPTAT), and a second one of the circuit branches used to produce a voltage complementary to absolute temperature (VCTAT), wherein with the VPTAT and the VCTAT are collectively used to produce the bandgap voltage output (VGO), and a plurality of resistors, the method comprising:

(a) selectively changing over time which of the resistors are connected to be within the first one of the circuit branches used to produce the VPTAT; and (b) selectively changing over time which of the resistors are connected to be within the second one of the circuit branches used to produce the VCTAT.

12. The method of claim 11, wherein steps (a) and (b) are performed such that:

at any given time the resistors that are connected within the first one of the circuit branches provide a first resistance, and the resistors that are connected within the second one of the circuit branches provide a second resistance; and the values of the first and second resistances can change over time so long as a ratio of the second resistance over the first resistance remains substantially constant.

13. A method for use with a bandgap voltage reference circuit that produces a bandgap voltage output (VGO), wherein the bandgap voltage reference circuit comprises a plurality of circuit branches that are collectively used to produce the bandgap voltage output (VGO), and a plurality of resistors, the method comprising:

(a) selectively changing over time which of the resistors are connected to be within a first one of the circuit branches; and (b) selectively changing over time which of the resistors are connected to be within a second one of the circuit branches;

wherein step (a) comprises (a.1) connecting a first group of the resistors in parallel with one another within the first one of the circuit branches at some times, and (a.2) connecting a second group of the resistors in parallel with one another within the first one of the circuit branches at other times; and wherein step (b) comprises (b.1) connecting the second group of the resistors in series with one another within the second one of the circuit branches at some times, and (b.2) connecting the first group of the resistors in series with one another within the second one of the circuit branches at other times.

14. The method of claim 13, wherein each of the resistors within the first and second groups of the resistors comprises a unit resistor that is substantially the same size as the other ones of the unit resistors within the first and second groups of the resistors.

15. The method 14, wherein steps (a) and (b) are performed such that each of the resistors within the first and second groups of the resistors spends about a same amount of time connected in parallel within the first one of the circuit branches as connected in series within the second one of the circuit branches.

16. The method of claim 11, wherein steps (a) and (b) are performed such that each of the resistors spends about a same amount of connected within the first one of the circuit branches as connected within the second one of the circuit branches.

17. A voltage regulator, comprising:

a bandgap voltage reference circuit to produce a bandgap voltage output (VGO); and an operation amplifier including a non-inverting (+) input that receives the bandgap voltage output (VGO), an inverting (−) input, and an output that produces the voltage output (VOUT) of the voltage regulator;

wherein the bandgap voltage reference circuit includes a plurality of resistors;

a plurality of circuit branches of the bandgap voltage reference circuit including a first one of the circuit branches used to produce a voltage proportional to absolute temperature (VPTAT), and a second one of the circuit branches used to produce a voltage complementary to absolute temperature (VCTAT), wherein with the VPTAT and the VCTAT are collectively used to produce the bandgap voltage output (VGO); and a plurality of switches to selectively change over time which of the resistors are connected to be within the first one of the circuit branches used to produce the VPTAT and which of the resistors are connected to be within the second one of the circuit branches used to produce the VCTAT.

18. The voltage regulator of claim 17, wherein the inverting (−) input of the operational amplifier is connected to the output of the operation amplifier.

19. The voltage regulator of claim 18, wherein the voltage regulator comprises a fixed output linear voltage regulator.

20. The voltage regulator of claim 17, further comprising:

a resistor divider to produce a further voltage in dependence on the voltage output (VOUT) of the voltage regulator;

wherein the inverting (−) input of the operational amplifier receives the further voltage produced by the resistor divider.

21. The voltage regulator of claim 20, wherein the voltage regulator comprises an adjustable output linear voltage regulator.

22. The voltage regulator of claim 17, further comprising:

a controller to control the switches.

23. The voltage regulator of claim 17, wherein:

the plurality of resistors include a first group of resistors, and a second group of resistors; and the plurality of switches include a first group of switches selectively connect the first group of resistors in parallel with one another within the first one of the circuit branches at some times, and selectively connect the first group of resistors in series with one another within the second one of the circuit branches at other times; and a second group of switches selectively connect the second group of resistors in series with one another within the second one of the circuit branches at some times, and selectively connect the second group of resistors in parallel with one another within the first one of the circuit branches at other times.

* * * * *